United States Patent [19]

Piggin

[11] Patent Number: 4,976,209

[45] Date of Patent: Dec. 11, 1990

[54] FURNACES FOR INCINERATING WASTE MATERIAL

[75] Inventor: Peter R. Piggin, Gaulby, United Kingdom

[73] Assignee: Erithglen Limited, United Kingdom

[21] Appl. No.: 340,677

[22] PCT Filed: Oct. 8, 1987

[86] PCT No.: PCT/GB87/00712

§ 371 Date: Mar. 29, 1989

§ 102(e) Date: Mar. 29, 1989

[87] PCT Pub. No.: WO88/02834

PCT Pub. Date: Apr. 21, 1988

[30] Foreign Application Priority Data

Oct. 11, 1986 [GB] United Kingdom ..... 8624421
Jul. 15, 1987 [GB] United Kingdom ..... 8716680

[51] Int. Cl.[5] ..... F23B 7/00

[52] U.S. Cl. ..... 110/234; 110/190; 110/235; 110/300; 122/2; 122/4 C

[58] Field of Search ..... 110/235, 234, 185, 187, 110/191, 256, 259, 300, 165 R, 190; 122/2, 4 C

[56] References Cited

U.S. PATENT DOCUMENTS

| | | | |
|---|---|---|---|
| 1,813,156 | 7/1931 | Gilchrist | 110/235 |
| 2,157,993 | 5/1939 | Woodman | 122/2 |
| 2,698,587 | 1/1955 | Knipe | 110/8 |
| 2,911,926 | 11/1959 | Kocee | 110/234 |
| 3,104,629 | 9/1963 | Crawford | 110/8 |
| 3,413,936 | 12/1968 | Matthews | 110/234 |
| 3,526,196 | 9/1970 | DeSeversky | 110/256 |
| 3,769,921 | 11/1973 | McMullen | 110/234 |
| 4,235,174 | 11/1980 | Spurrell | 110/234 |
| 4,454,828 | 6/1984 | Zempel | 110/248 |
| 4,495,872 | 1/1985 | Shigaki | 110/190 |
| 4,502,397 | 3/1985 | Hochmuth | 110/234 |

FOREIGN PATENT DOCUMENTS

| | | |
|---|---|---|
| 3345087 | 6/1985 | Fed. Rep. of Germany . |
| 2057275 | 5/1971 | France . |
| 467433 | 2/1969 | Sweden . |
| 1468094 | 3/1977 | United Kingdom . |
| 2092294 | 8/1982 | United Kingdom . |

*Primary Examiner*—Edward G. Favors
*Assistant Examiner*—Denise L. Ferensic
*Attorney, Agent, or Firm*—Vincent L. Carney

[57] ABSTRACT

A vertical chamber for waste disposal and heating purposes has an upright combustion chamber with an inlet for waste material, a grating at a lower chamber end and an adjustable burner controlled by a temperature sensor so that the burner operation can be adapted to allow for the calorific value or requirement of the material to be incinerated. A trap door is situated at the lower end for ash removal and is arranged by air passages to permit air to pass upward past the door for combustion and to open periodically for removing ash. The grating may be water cooled and step down towards the trap door to permit ash to be blown off onto the door before the door is opened.

12 Claims, 6 Drawing Sheets

FURNACES FOR INCINERATING WASTE MATERIAL

TECHNICAL FIELD

The invention relates to furnaces for incinerating waste material, which material has unpredictable burning characteristics, and may oxidize endothermically or exothermically.

BACKGROUND ART

Some organisations, such as hospitals, are compelled by regulation to dispose of their waste material by incineration. In order to reduce the cost, incurred due to the fuel consumption of the furnace, of incinerating the waste material, attempts have been made to recover and utilize the waste heat produced during the incineration process. The most cost-effective methods of recovery proposed thus far, involve systems using a waste heat recovery boiler, capable of raising steam for, example a central heating system, connected to a pyrolitic incinerator. Such systems must, however, satisfy the strict regulations concering air pollution. The systems must also be regularly loaded with waste material and regularly de-ashed, in order to prevent build-up, if the system is to operate efficiently. This necessitates constant supervision and maintenance, and although mechanisms for the automatic de-ashing of furnaces have been proposed, the mechanisms presently in use or disclosed in GB No. 1275304A (FABRY), which attempt to avoid any interruption of the incineration process, can be considerably complex.

THE INVENTION

A furnace according to the invention is characterised by a trap door situated at a lower part of the combustion chamber arranged to permit air for combustion to pass upwards past the door in the closed condition and to open for removing ash from the combustion chamber periodically when required.

The invention is also preferably provided with a means, such as a screw conveyor, for removing ash from below the trap door. The passage of air upwards past the trap door ensures that the door is cooled, that the combustion of waste material is promoted and that the door can be readily operated even after ash has accumulated upon it. The door may have additional apertures to assist air passage into the combustion chamber. Preferably the door is associated with a grating, conveniently at an end thereof, which may be downwardly inclined to the door or may be level, and blowing means arranged to blow through the grating and assist in maintaining ash fluidity and to help ash to accumulate preferably on top of the door.

DRAWINGS

CONSTRUCTION BY REFERENCE TO DRAWINGS

Figure 1:
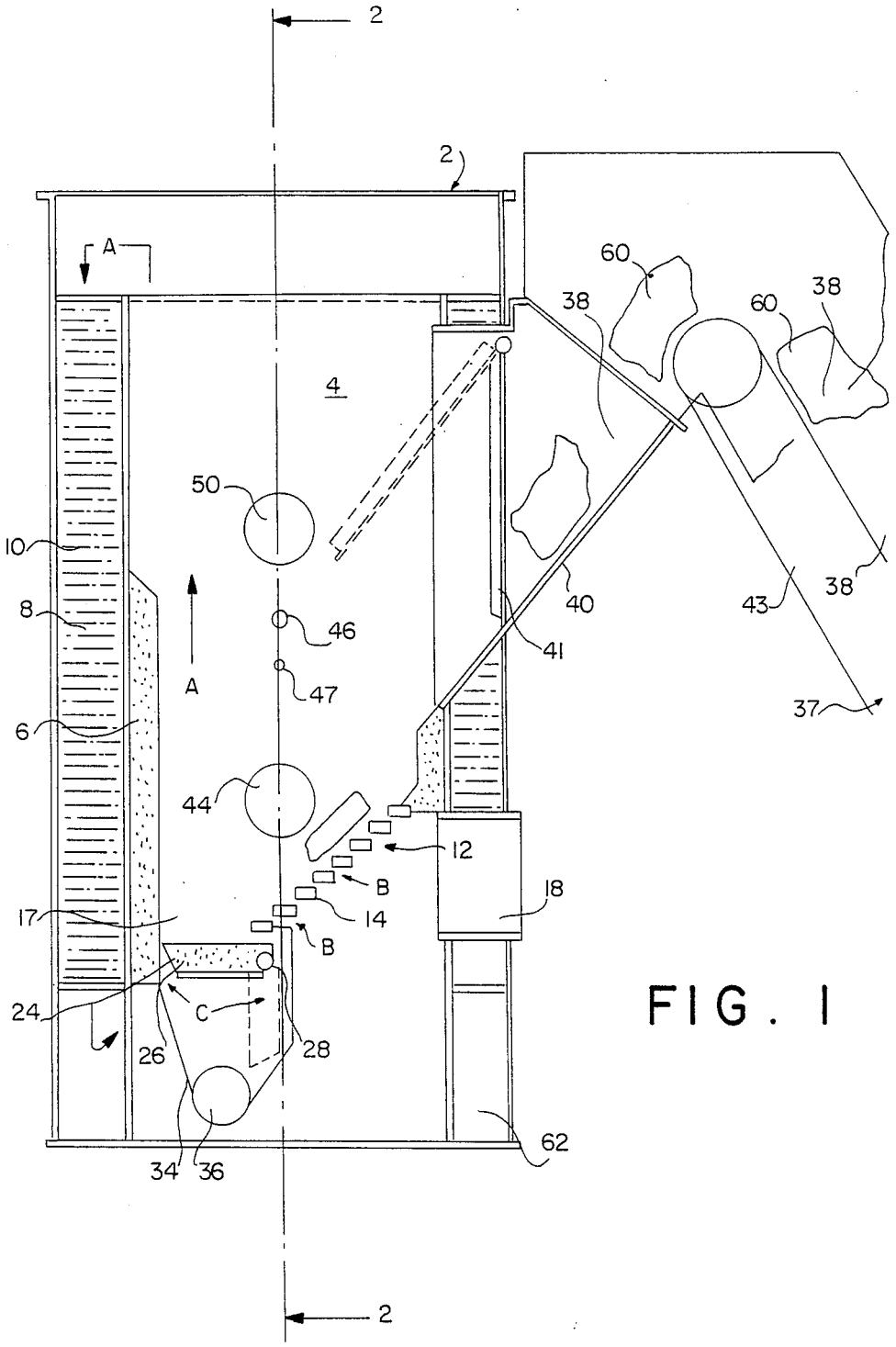
FIG. 1 is a vertical section through a three-pass boiler/incinerator according to the invention.

With reference to the Figures a three-pass boiler or incinerator with a vertical combustion chamber forming the furnace is generally indicated at 2. The boiler contains a chamber 4 which is lined with refractory 6 and has a water jacket 8 with spaces 10 for boiler tubes 9 (FIGS. 5,6) and for air passages and has reversal chambers 11 to allow air to move from the chamber 4 down along the outside of the refractory lining past the boiler tubes and hence upwards again in the conventional arrangement of a three-pass boiler as shown by arrows A. In FIG. 6 a sector marked X provides for a downward flow past the boiler tubes 9 and sector Y for an upward flow leading to an induced draft fan 33 shown in FIG. 5. The boiler may be a wet back boiler with a header on top of the chamber for air emerging from sector Y.

At a lower chamber end a grating array 12 is provided which includes a step-wise arrangement of hollow, rectangular section grating tubes 14. The tubes 14 are spaced vertically and horizontally. Sequentially operable air blast nozzles 120 may be located behind and below (see FIG. 7B) so as to leave an air gap to provide the requisite flow. As shown in the Figures the tubes 14 lie parallel to each other but have a longitudinal axis inclined slightly upwards to the horizontal to permit gravity flow. An external access door 62 is provided at the lower end. Where appropriate air may be drawn in through this door or other opening at a similar level for aiding combustion.

A fan 18 blows air underneath the grating as shown by arrow B. The air blown below passes between the tubes 14 into the combustion space generally indicated at 17 and helps to ensure that material to be incinerated is burned on the steps.

Figure 5:
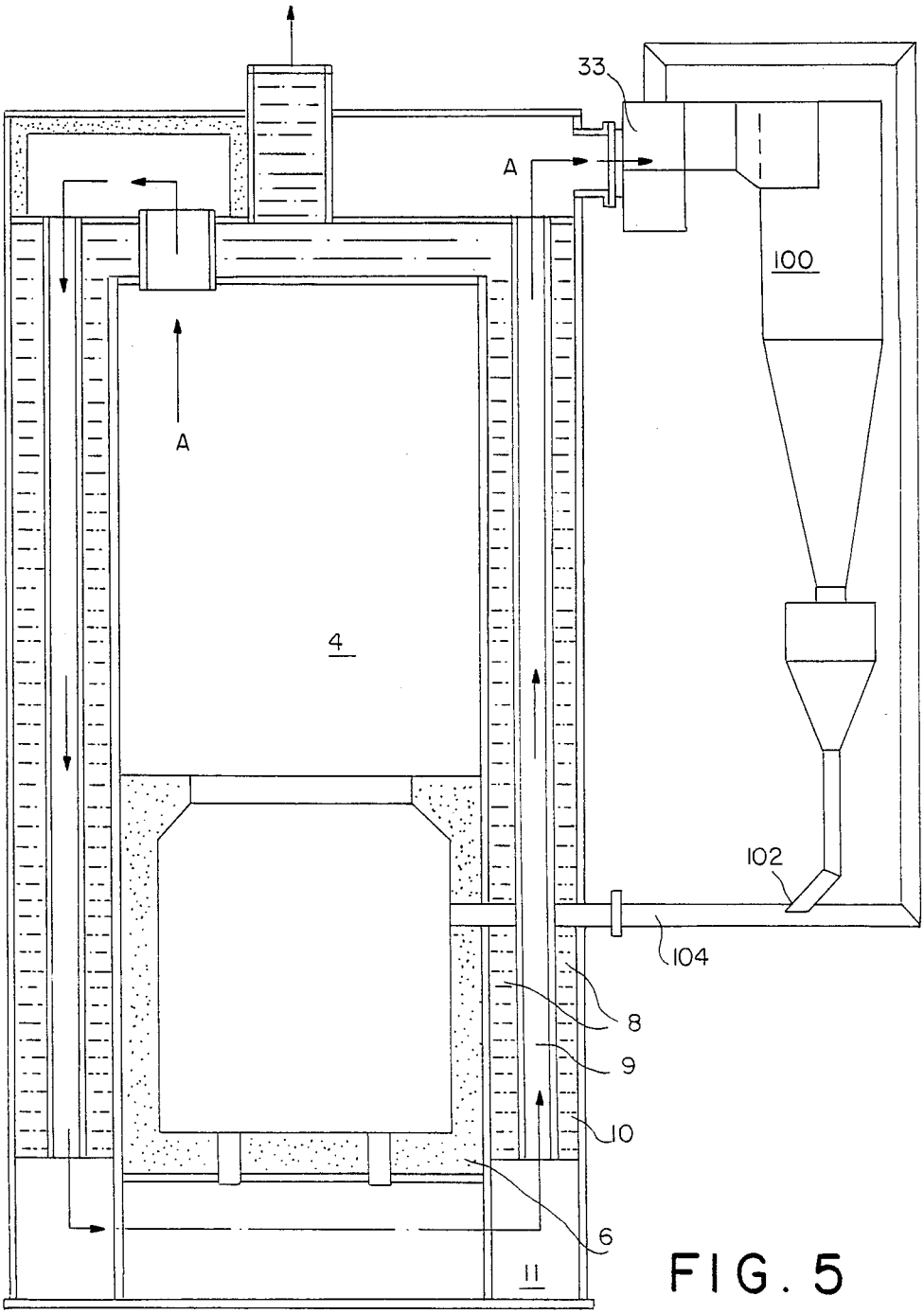
FIG. 5 is a vertical section of the incinerator of FIG. 1 to illustrate the overall configuration.
Figure 6:
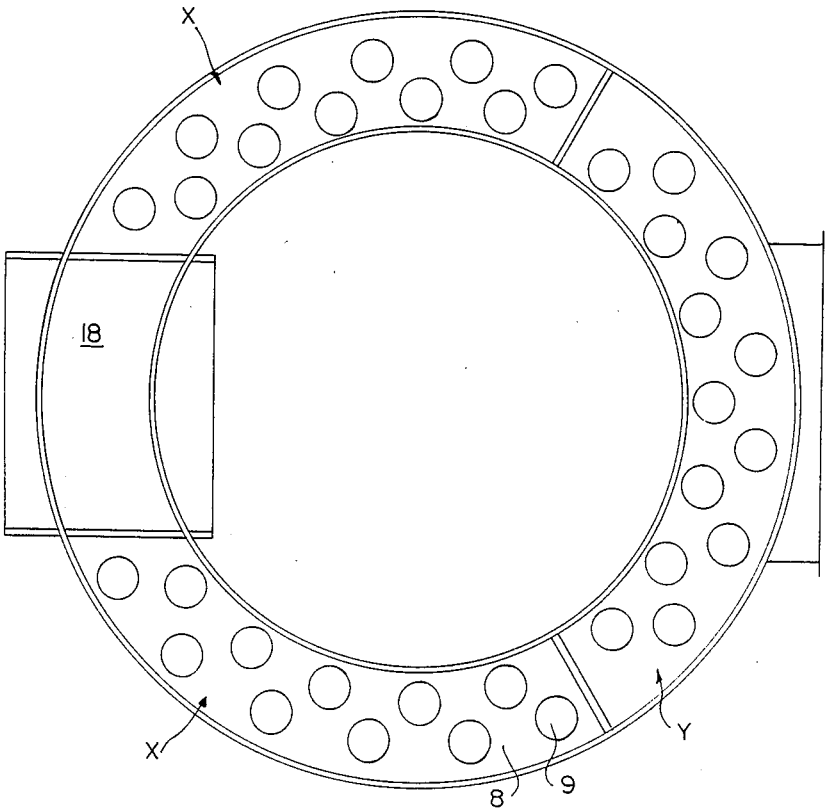
FIG. 6 is a transverse section of FIG. 5 showing three-pass boiler tube lay-out.

Alternatively air may be drawn in at this location by the induced draft fan 33 (FIG. 5). Adjacent the lower tube 14 of the array 12, there is mounted a substantially semi-circular trap door 24 carrying on its upper face a lining 26 and pivotable bodily through a pivot shaft 28 by means of an actuating lever connected at 30. In larger boilers the trap door may be circular and be pivoted aling a substantially diametrical axis, but may in any event be unbalanced to assist the initial opening movement. The trap door 24 is received with approximately 20 mm clearance all around in the bottom of the chamber 4 in the closed condition shown in solid lines in FIG. 1 and air can pass upwards through the gap into the combustion chamber as shown by arrows C. The gap is indicated at 32.

At the top of the chamber 4 there is provided an inlet for waste materials to be incinerated, which inlet includes a chute 40 to the chamber 4. A means for supplying waste materials to be incinerated is provided by a conveyor 43 which leads from a storage area 37 to an upwardly inclined slope. Three infrared cells 38 are provided and the conveyor 43 can be operated so that one container, such as a bag or box can pass one at a time through the door 41 which is shown in dotted lines in the open condition of FIG. 1. The conveyor 43 or elevator may run in reverse a short distance after one container with waste material has been discharged down the chute to avoid any unintentional delivery of the next container.

Figure 2:
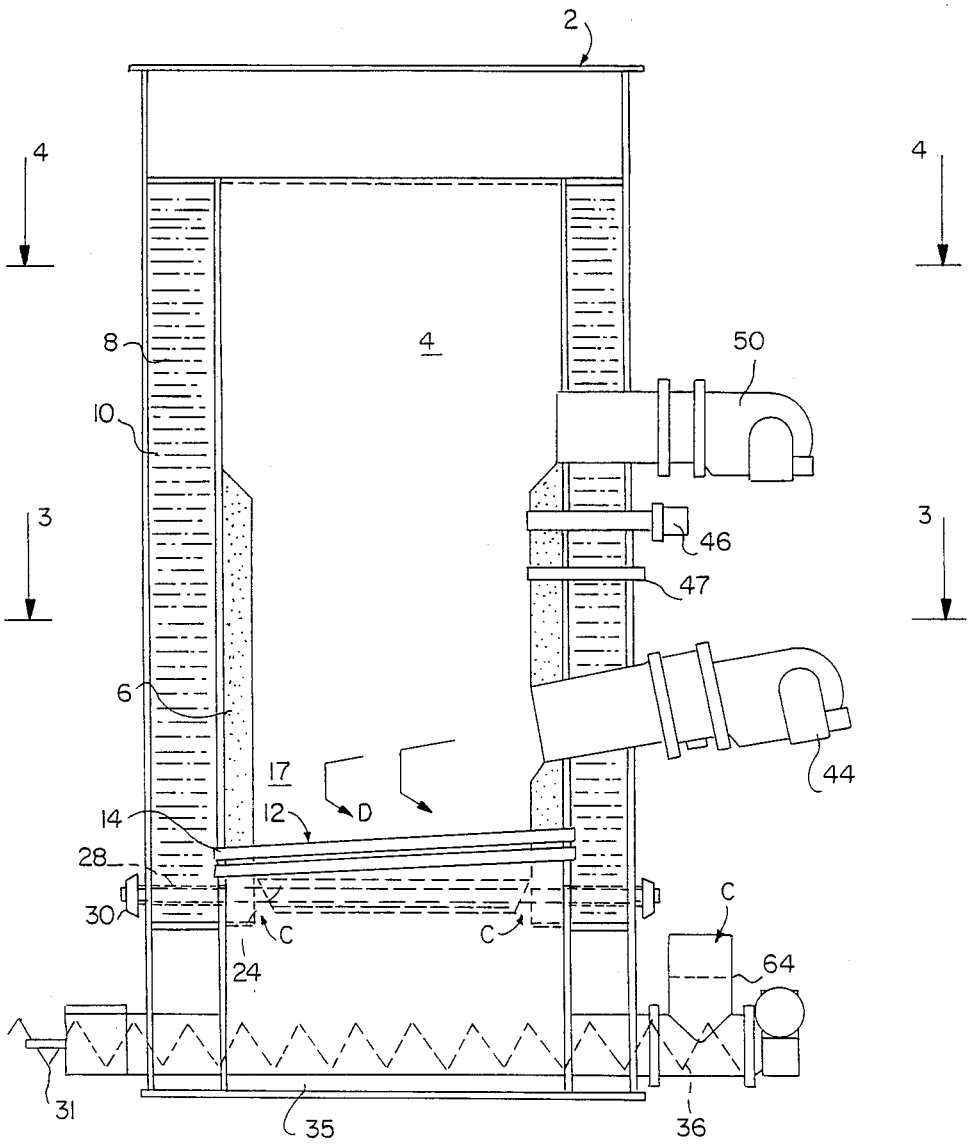
FIG. 2 is a vertical section along line 2—2 in FIG. 1.
Figure 4:
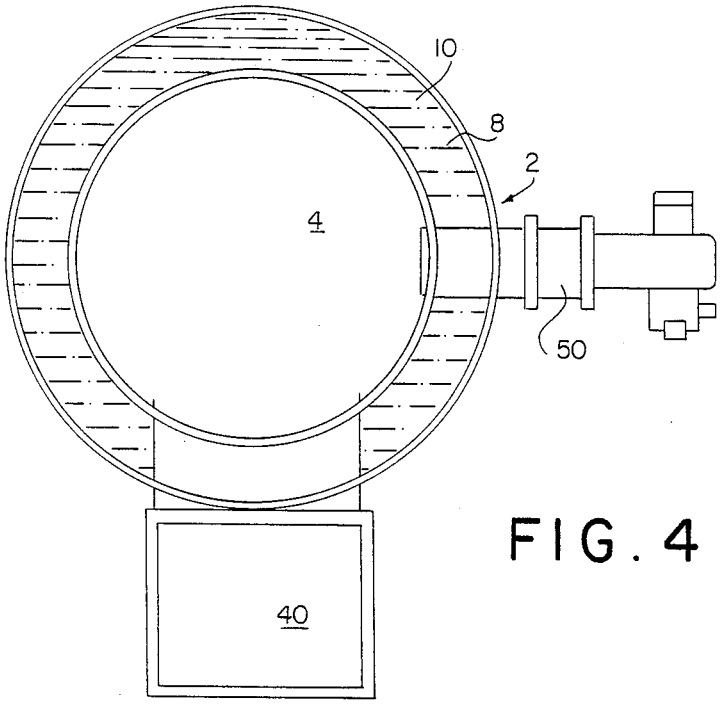
FIG. 4 is a horizontal section along line 4—4 in FIG. 2.
Figure 3:
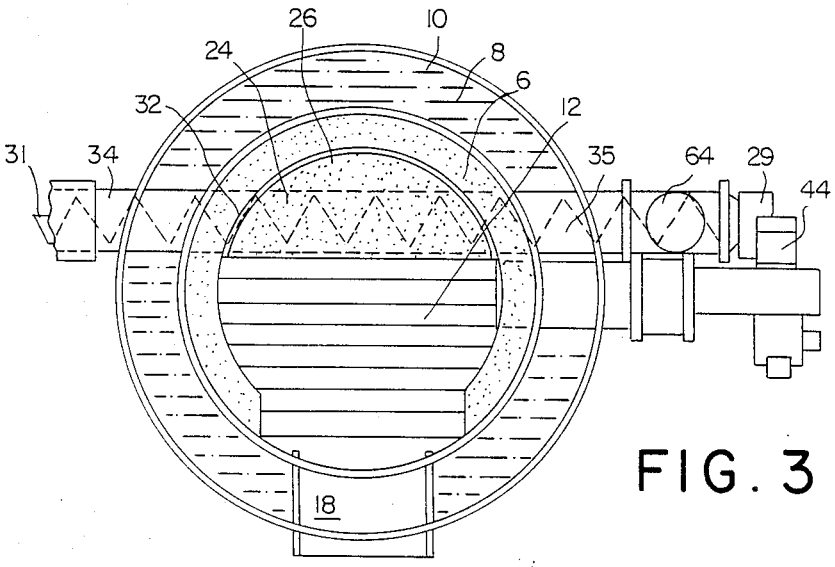
FIG. 3 is a horizontal section along line 3—3 in FIG. 2.

A burner 44 is mounted extending substantially radially with respect to the chamber 4 but arranged so as to project fuel admixed with air for combustion in a slightly downward direction (see FIG. 2) as shown by arrow D. The burner 44 is associated with control means which enables it to supply varying amounts of fuel or to be switched off in a manner explained later on. The burner 44 is arranged to swirl the flames around and create the most intensive combustion over the trap door 24 to ensure that any waste material on the trap door is properly incinerated.

A thermo-couple is mounted in a tube 46 to extend through the refractory lining to monitor the combustion temperature. A second tube 47 is fitted with a draught controller to maintain a constant negative pressure in the firing chamber created by the main induced draft fan on the outlet side. A further fan for supplying secondary air for completing volatile combustion may be arranged in the upper region of the combustion chamber 4 but preferably a secondary burner 50 is used. Both burner 44 and 50 are of a type in which air is drawn in by the burner for admixture with fuel for combustion.

The induced draft fan 33 sucks into it on the inlet side the exhaust flue. It blows the mixture to a cyclonic separator 100 (FIG. 5) which may have a recirculation passage back to the fan 33. The grit particles separated in the separator 100 may be sucked by a Venturi arangement 102 and passed back into the furnace using high pressure outlet air of the fan 33 passed through duct 104 or may be collected and removed by a rotary valve periodically. Thus the final mixture from the separator contains no grit and can be passed to atmosphere.

OPERATION

In use of the boiler, a system will control operation of the conveyor 43, the burners 44 and 50, the fan 18 and the screw conveyor 35. During a fuel burning/waste incinerating mode of operation, the conveyor 43 will advance bags of waste material or any suitable material for incineration upwardly on the conveyor to the chute 40. Assuming the burner 44 is operating and assuming no waste material has, as yet, been dropped previously into the chamber 4, a desired combustion temperature will have been established in the combustion chamber 4 by using the burner 44 and the air admixed thereto in conjunction with the thermo-couple 46. In such a 'gas-/oil only' mode the fan 18 and burner 50 are off and the valve 64 is shut. This only opens when the boiler has to incinerate waste. As a result of this operation of course heated water will be produced by the boiler as water is heated by the boiler tubes in the mantle 8 surrounding the chamber 4.

Assuming that it is desired to burn waste material, a bag of waste material 60 will be introduced through the chute 40 and door 41. The valve 64 will open after the door has closed. The burner 50 will commence operation. This bag will fall on top of the grating array 12 and tumble down into the combustion space 17. Subsequently, at regular intervals controlled by a timer further bags of waste materials will be dropped through the chute so that a row of a few bags will form which will work its way gradually down as the waste material at the bottom of the stack is finally and fully combusted in the combustion zone 17. The boiler is now acting in a manner functionally equivalent to an incinerator but the boiler will continue to produce heated water. In the course of this incinerating operation two matters should be noted.

Firstly, the air flow from the fan 18 from below the grating 12 will have a fluidising effect on the ash collecting on the grating tubes 14. Also the collection of ash in the gap between the door 24 and the surrounding chamber wall is prevented by the air flow through the gap 32. Secondly, the thermo-couple continues to monitor the combustion temperature inside the chamber 4. Should the waste material contain material of a high calorific value, the control system will turn the burner 44 down to a low fire condition. If the waste material has a sufficiently high calorific value, the burner 44 can in fact be turned off altogether. Should the waste material be such that a considerable heat input is needed to ensure incineration, the burner 44 can be turned to a full fire condition so as to try and maintain the desired combustion temperature. In addition of the combustion temperature exceeds the desired operating limit the control system can interfere with the conveyor 43 so as to prevent the supply of further waste material until the combustion conditions have normalised. This also prevents overfeeding of waste.

Because of these combustion controls, the air passing through the combustion chamber 4 is of fairly constant composition, containing relatively little non-combusted material and being of a fairly high temperature. These conditions are maintained, in the manner explained, whatever the variation in the composition of the waste material. Thus the air circulation induced by the fan 33 can be used to prolong combustion with a good excess of oxygen whilst the air gradually travels upwards. The flues emerging from the combustion chamber 4 are substantially free of pollutants. The incineration operation can be continued or the control settings can be changed back to normal boiler operation using the burner 44 only.

It is a special feature of the boiler that ash can be removed at regular frequencies. For this operation the conveyor 36 is switched off to allow all waste materials to be fully combusted. The burner goes to a high-fire condition for a preset time and the air flow through the grating is stopped. This condition causes any metal at the bottom of the chamber to become red-hot and soft for facilitating removal. The burner 50 is switched OFF to avoid pressurising the boiler system, if appropriate. The ash lying on the tubes 14 has been kept fairly loose by the continuous passage of air through the grating 12 during incineration and due to the descent of material to be incinerated. In this way the ash is caused to move down onto the grating tube below so that the bulk of the ash accumulates on top of the refractory lining 26 of the trap door 24. The burner 44 goes to a low-fire condition to avoid projecting the flame to below the level of the closed door. The trap door is pivotted by the actuating lever 30 to the open condition so that the ash drops into the housing 34 for the screw conveyor 35. Next the screw 36 is rotated to remove all the ash and any other debris for collection. The screw conveyor permits fine ash as well clumps of waster material which will not burn wuch as metal material, to be removed without difficulty. Next the trap door 24 is closed and the boiler can once more resume normal operation. Because ash removal can be performed so simply and reliably, the boiler 2 can be kept free off ash to substantial extent and the flow of air through the grating 12 and the combustion conditions for the fuel supplied by the burner 44 and the waste material passing through the chute 40 can be kept fairly constant.

Figure 7A:
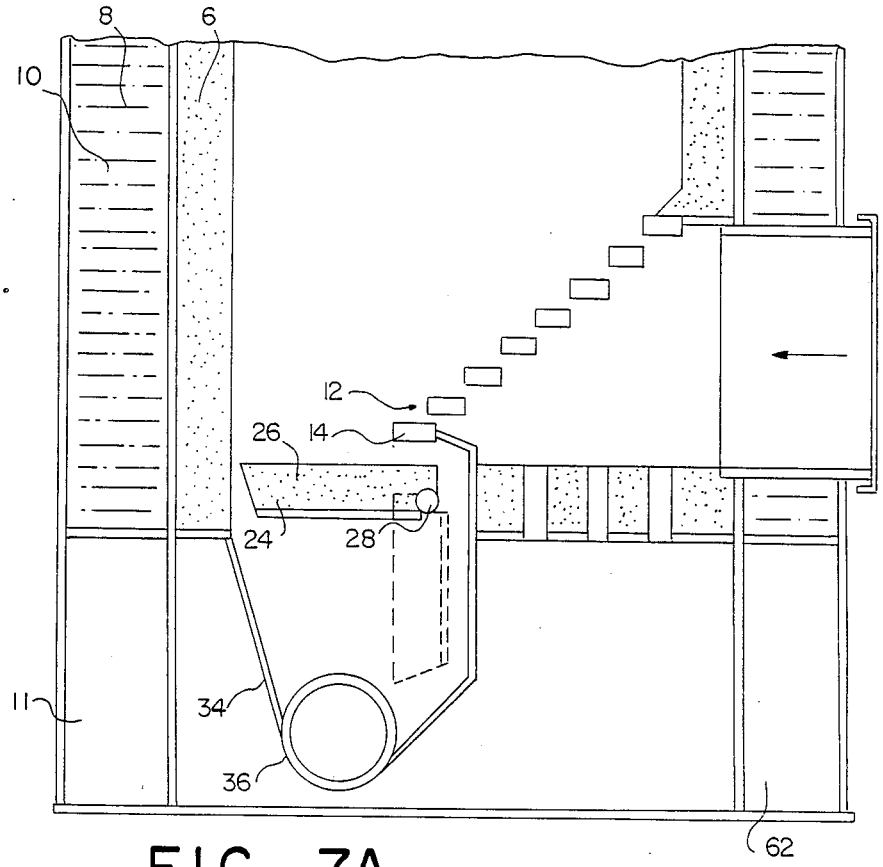
FIG. 7A is an enlarged, part section of a modified lower end of FIG. 1 showing in FIG. 7B a yet further enlarged side view of part of the grating in the lower end.
Figure 7B:
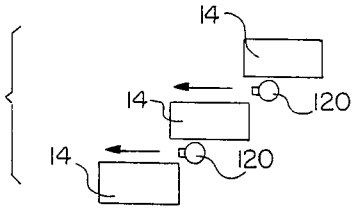

FIG. 7B illustrates how where required de-ashing can be promoted by a timed blast of compressed air released from nozzles 120 under solenoid valve control (not shown). The different grating levels may be treated in sequence so as to cause the ash to move down step by step.

A detailed sequence of the operation follows:

(1) Gas/Oil Only Mode

Gas/oil only supplied through the burner 44 admixed with air. The induced draft fan 33 is ON but fan 18 and burner 50 will be OFF and valve 64 closed.

(2) Incineration Mode (a) photo-electric cell 38 at lower conveyor end detects material to be incinerated.
|
(b) Chute door 41 opens
|
(c) Conveyor 43 starts
|
(d) Photo-electric cell 38 at chute 40 detects passage of material from conveyor.
|
(e) Conveyor 43 stops (and reverses to prevent toppling over)
|
(f) Door 41 closes
|
(g) Valve 64 opens to a preset position, burner 50 switches ON Thermocouple controls burner 44 to ensure correct temperature.

Repeat a to f using timer of control system, unless overridden.

If temperature rises:

Burner 44 goes to a low fire condition
|
If temperature continues to rise:
|
Burner 44 is switched OFF
|
Burner fan (not shown) has a control valve for air (not shown) which is left fully open If temperature continues to rise:
Conveyor 43 stopped, timer is overridden.
If temperature drops:

Burner 44 is set to high fire condition
|
If necessary conveyor 43 is stopped and timer is overridden until correct temperature is reached When the photo-electric cell 38 at the top of the conveyor 43 sees no waste, then the control system returns automatically normal burning gas/oil only mode, closing valve 64 and switching off fan 18 and burner 50.

From time to time it may be necessary to clear the grating of ash and remove ash deposits from below the grating through suitable access doors by hand, using scraping instruments, but the incidence of this operation can be greatly reduced.

ADVANTAGES

Using the boiler it is no longer necessary to load incinerators by hand or to remove ash by shutting down the incinerator and removing the ash by manual raking out except occasionally, typically once a day. All the heat generated by the waste material can be effectively utilized and smoke generating conditions can be largely avoided.

The cooled grating has a long life and facilitates ash removal. The trap door could be slidable as well as pivotable but is preferably as small as possible as is consistent with easy ash removal. The inclined tubes 14 permit the grating 12 to be cooled using the same water circuit as is used in the jacket 8. The large cross-sectional area ensures flow in all circumstances. The conveyor 43 may be replaced by a variety of arrangements for supply waste material containers. The waste material could be dropped down by a conveyor from a floor above or in any other convenient manner. The screw conveyor for removing ash could also be replaced by a simple chute or by a pneumatic system for removing ash.

The burner 44 is arranged so that the flame swirls into the bottom of the combustion space 17 ensuring that combustion is complete at the lowermost part of the combustion space 17.

Using the invention a simple furnace arrangement can be used to serve a variety of user requirements whilst providing for a lowering of the gas or oil fuel costs. The heat recovered from the waste material in this manner exceeds the heat which could be recovered by extracting heat from the exhaust flues of a conventional incinerator.

FIG. 7A shows a modified construction for the lower chamber part. A refractory floor is provided which may have apertures to promote ash fluidity or which may be solid. In yet a further modified form the stepped grating may be absent and a grating may be provided level with the door which may or may not be water cooled and/or provided with air apertures for ash fluidity promotion. Such a construction would be more appropriate for larger incinerator capacities and where waste is not in a bag of roughly constant size. Where an air apertured floor is used as a grating, air drawn in from below the floor aids in keep the apertures clear of ash or debris.

I claim:

1. A furnace for incinerating waste material comprising an upright combustion chamber;

an inlet means at an upper part of the combustion chamber for supplying the waste material;

a temperature sensor;

a burner at a lower part of the combustion chamber;

means for supplying fuel to the burner;

said means for supplying fuel being adjustable in response to the temperature sensed by the temperature sensor to maintain the inside of the combustion chamber at a temperature sufficient for the incineration of the waste material;

a water cooled jacket surrounding the combustion chamber;

a trap door situated at a lower part of the combustion chamber; and means for causing air for combustion to pass upwardly past the trap door while the trap door is closed and to open the trap door for removing ash from the combustion chamber periodically when required.

2. A furnace according to claim 1 wherein a screw conveyor is arranged below the trap door for removing ash.

3. A furnace according to either claim 1 or claim 2: wherein there is provided a grating in the combustion chamber;

said grating being generally downwardly inclined for permitting the waste material to be incinerated to descend gradually;

said furnace including blowing means for blowing air into the grating for urging ash to descend;

said trap door being situated at the lower end of the grating.

4. A furnace according to claim 2 wherein there is provided a grating in the combustion chamber and the grating is water cooled.

5. A furnace according to claim 4 wherein the grating contains upwardly inclined passages connected to an overall water circuit for permitting flow by gravity.

6. A furnace according to claim 4 wherein the burner is arranged to project a flame transversely over the trap door to create intensive combustion over the trap door.

7. A furnace according to claim 4 wherein the grating is formed by vertically offset boiler tubes forming a plurality of steps in an inclined array.

8. A furnace according to claim 1 wherein a further burner is provided at an upper part of the combustion chamber for promoting complete combustion.

9. A furnace according to claim 1 further comprising;

a hopper for storing material to be incinerated;

a conveyor for receiving material from the hopper;

a chute for conveying material downwards from the end of the conveyor through the inlet means in the combustion chamber;

a door in the inlet means and an associated operating means for operating the door when required; and means for controlling the conveyor and the associated operating means in response to at least one of the presence of waste material carried by the hopper, waste material carried by the conveyor and the furnace condition.

10. A furnace according to claim 9 wherein the conveyor is an elevator for supplying waste material containers one at a time, to the chute.

11. A furnace according to claim 10 wherein the elevator is controlled to pass the waste material containers at regular intervals.

12. A furnace according to claim 10 or claim 11 wherein the elevator and door are controlled to stop feeding waste material if the furnace temperature sensed by the sensor is excessively high or excessively low.

* * * * *